US011274835B2

(12) United States Patent
Moon et al.

(10) Patent No.: US 11,274,835 B2
(45) Date of Patent: Mar. 15, 2022

(54) AIR CONDITIONER

(71) Applicant: Samsung Electronics Co., Ltd., Suwon-si (KR)

(72) Inventors: Hong Yeol Moon, Hwaseong-si (KR); Hyun-Ho Kim, Suwon-si (KR); Chul Byung Park, Ansan-si (KR); Hyeon U Park, Suwon-si (KR); Seung-Jun Yoon, Suwon-si (KR); Jang Jung Lee, Hwaseong-si (KR); Jei Min Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 275 days.

(21) Appl. No.: 15/963,396

(22) Filed: Apr. 26, 2018

(65) Prior Publication Data

US 2018/0313551 A1 Nov. 1, 2018

(30) Foreign Application Priority Data

Apr. 28, 2017 (KR) ..... 10-2017-0055523

(51) Int. Cl.
*F24F 1/0011* (2019.01)
*F24F 1/0047* (2019.01)
*F24F 13/14* (2006.01)

(52) U.S. Cl.
CPC ..... *F24F 1/0011* (2013.01); *F24F 1/0047* (2019.02); *F24F 13/1426* (2013.01); *F24F 2013/1433* (2013.01)

(58) Field of Classification Search
USPC ..... 454/304
See application file for complete search history.

(56) References Cited

U.S. PATENT DOCUMENTS 4,012,923 A * 3/1977 Lundgren ..... B21B 35/14 464/90
4,541,326 A * 9/1985 Fukuda ..... F24F 13/1426 236/49.5
4,726,563 A * 2/1988 Inglis ..... F24F 13/14 181/258

(Continued)

FOREIGN PATENT DOCUMENTS

CN 204901976 12/2015
CN 105526695 4/2016

(Continued)

OTHER PUBLICATIONS

International Search Report dated Jul. 31, 2018 in International Patent Application No. PCT/KR2018/004247.

(Continued)

*Primary Examiner* — Edelmira Bosques
*Assistant Examiner* — Frances F. Hamilton
(74) *Attorney, Agent, or Firm* — Staas & Halsey LLP

(57) ABSTRACT

Disclosed herein is an air conditioner. The air conditioner include a housing having a discharge port, a blade located in the discharge port where the blade is rotatable with respect to the housing, a blade driving member configured to rotate the blade, and an elastic member located between the blade and the blade driving member and the elastic member including a stopper coupleable to the blade driving member.

17 Claims, 8 Drawing Sheets

(56) References Cited

U.S. PATENT DOCUMENTS

| | | | | | |
|---|---|---|---|---|---|
| 5,112,024 | A * | 5/1992 | Stanko | F16F 15/046 248/603 |
| 5,443,420 | A * | 8/1995 | Kim | F24F 1/0011 454/256 |
| 5,449,153 | A * | 9/1995 | Catalano | F04D 29/668 267/141.2 |
| 5,732,565 | A * | 3/1998 | Ramakrishnan | F24F 13/20 62/277 |
| 6,511,291 | B2 * | 1/2003 | Koochingchai | F04D 17/04 384/434 |
| 7,399,222 | B2 * | 7/2008 | Moon | F24F 1/0011 454/277 |
| 7,566,262 | B2 * | 7/2009 | Hu | F24F 7/007 454/284 |
| 10,132,514 | B2 * | 11/2018 | Hu | F24F 7/007 |
| 2014/0231051 | A1 | 8/2014 | Cho et al. | |
| 2017/0067681 | A1 * | 3/2017 | Kim | F24F 1/0047 |
| 2017/0205083 | A1 * | 7/2017 | Obara | F04D 25/06 |
| 2018/0313569 | A1 * | 11/2018 | Moon | F24F 1/00 |

FOREIGN PATENT DOCUMENTS

| | | | | |
|---|---|---|---|---|
| CN | 106100194 | A * | 11/2016 | |
| CN | 106871243 | A * | 6/2017 | |
| DE | 4402546 | C2 * | 3/1997 | F24F 13/1426 |
| EP | 3141836 | | 3/2017 | |
| JP | 09112944 | A * | 5/1997 | F24F 1/0057 |
| JP | 11-14134 | | 1/1999 | |
| JP | 2003-262354 | | 9/2003 | |
| JP | 2004-348019 | | 12/2004 | |
| JP | 2004348019 | A * | 12/2004 | |
| KR | 1997-0047404 | | 7/1997 | |
| KR | 1999-018960 | | 3/1999 | |
| KR | 20040034142 | A1 * | 10/2002 | |
| KR | 10-2004-0034142 | | 4/2004 | |
| KR | 10-0530893 | | 11/2005 | |
| KR | 10-0576132 | | 5/2006 | |
| KR | 10-2012-0050325 | | 5/2012 | |
| KR | 10-2014-0123184 | | 10/2014 | |
| KR | 10-2015-0102674 | | 9/2015 | |
| WO | 2015/130073 | | 9/2015 | |
| WO | WO-2015130073 | A2 * | 9/2015 | F24F 13/14 |
| WO | WO-2016074607 | A1 * | 5/2016 | F24F 1/00 |

OTHER PUBLICATIONS

Extended European Search Report dated Feb. 24, 2020 in European Patent Application No. 18789987.7.

Chinese Office Action dated Nov. 3, 2020 from Chinese Application No. 201810396502.9, 18 pages.

Chinese Office Action dated Jun. 25, 2021 from Chinese Application No. 201810396502.9.

Korean Office Action dated Sep. 16, 2021 from Korean Application No. 10-2017-0055523.

* cited by examiner

AIR CONDITIONER

CROSS-REFERENCE TO RELATED APPLICATION(S)

This application claims the benefit of Korean Patent Application No. 10-2017-0055523, filed on Apr. 28, 2017 in the Korean Intellectual Property Office, the disclosure of which is incorporated herein by reference.

BACKGROUND

1. Field

Embodiments of the present disclosure relate to an air conditioner, and more particularly, to an air conditioner having an improved structure.

2. Description of the Related Art

In general, an air conditioner refers to an electronic device to improve thermal comfort by conditioning indoor air using a refrigeration cycle of a refrigerant and includes an indoor unit including a heat exchanger, a blower fan, and the like and located in an indoor room, an outdoor unit including a heat exchanger, a blower fan, a compressor, a condenser, and the like and located outside, and a refrigerant pipe to connect the outdoor unit and the indoor unit and circulate the refrigerant.

Air conditioners may be classified, according to installation location of indoor units, into standing-type air conditioners in which an indoor unit is mounted on the floor, wall-mounted air conditioners in which an indoor unit is installed at a wall, and ceiling-type air conditioners in which an indoor unit is installed at a ceiling. In a ceiling-type air conditioner, an indoor unit is recessed in or mounted on the ceiling.

Since an indoor unit of a ceiling-type air conditioner is installed at a ceiling, a suction port to suck air from an indoor room and a discharge port to return the air heat-exchanged by a heat exchanger to the indoor room are provided at lower portions of a main body. Indoor units of ceiling-type air conditioners may be classified, according to the number of discharge ports, into 1-way type indoor units in which one discharge port is provided and 4-way type indoor units in which four discharge ports are provided in a rectangular shape.

In general, an indoor unit of an air conditioner includes a blade disposed in a discharge port and configured to adjust a direction of heat-exchanged air which is discharged therethrough. The blade is rotatably coupled to one side of the discharge port. A motor is coupled to at least one side of the blade and the blade is rotated by a rotational force generated by the motor.

SUMMARY

Therefore, it is an aspect of the present disclosure to provide an air conditioner including an easily detachable blade.

It is another aspect of the present disclosure to provide an air conditioner including a blade easily maintained and repaired.

It is another aspect of the present disclosure to provide an air conditioner capable of reducing noise or vibration while a blade rotates.

It is another aspect of the present disclosure to provide an air conditioner capable of discharging air using various methods.

It is another aspect of the present disclosure to provide an air conditioner capable of cooling and/or heating an indoor room at a minimum wind speed providing a user with comfort.

Additional aspects of the disclosure will be set forth in part in the description which follows and, in part, will be obvious from the description, or may be learned by practice of the disclosure.

In accordance with an aspect of the present disclosure, an air conditioner includes a housing having a discharge port, a blade located in the discharge port and the blade being rotatable with respect to the housing, a blade driving member configured to rotate the blade, and an elastic member located between the blade and the blade driving member and the elastic member including a stopper coupleable to the blade driving member.

The blade driving member may include a drive source configured to generate power to rotate the blade and a power transmission member to transmit the power generated by the drive source to the blade, wherein the power transmission member may include an elastic member fixing portion to which the stopper is coupled.

The blade driving member may include a driving member cover to cover the drive source and at least a portion of the power transmission member, the driving member cover may include a driving member support portion provided to support the power transmission member in a direction opposite to a separation direction of the blade while the blade is separated from the blade driving member.

The power transmission member may include a rib protruding to be supported by the driving member support portion.

The elastic member may be fixed to the power transmission member and separated from the blade while the blade is separated from the blade driving member.

The power transmission member may include an extended portion extending along a rotation axis direction of the blade, the extended portion being formed in a polygonal pillar shape, and the elastic member may include a driving member insertion portion formed to accommodate the polygonal pillar shape of the extended portion so that the extended portion is inserted into the driving member insertion portion.

The stopper may protrude from an inner surface of the driving member insertion portion and the elastic member fixing portion may be formed in a groove form at an outer surface of the extended portion.

The blade may include an elastic member insertion portion formed to accommodate a shape of the elastic member to allow the elastic member to be inserted into the elastic member insertion portion.

The elastic member may be inserted into the elastic member insertion portion by interference fitting.

The elastic member may have a polygonal pillar shape.

The elastic member may include rubber.

The housing may be installed at a ceiling.

The blade may be configured to open or close the discharge port.

The blade may include a plurality of air discharge holes penetrating the blade.

In accordance with an aspect of an example embodiment, an air conditioner includes a housing installed at a ceiling, the housing including a discharge port, a blade configured to rotate with respect to the housing to open or close the discharge port, the blade including a plurality of air discharge holes, a blade driving member including a drive source, where the blade driving member is configured to rotate the blade, and an elastic member located between the blade and the blade driving member, wherein the elastic member is coupleable to the blade driving member and separable from the blade while the blade is separated from the blade driving member.

The blade driving member may include a driving member cover to cover the drive source, wherein the driving member cover may include a driving member support portion configured to support the blade driving member in a direction opposite to a separation direction of the blade while the blade is separated from the blade driving member.

The blade driving member may include an elastic member fixing portion formed in a groove shape, and the elastic member may include a stopper inserted into the elastic member fixing portion.

The elastic member may be formed in a hexagonal pillar shape, and the blade may include an elastic member insertion portion formed to accommodate the hexagonal pillar shape of the elastic member to allow the elastic member to be inserted into the elastic member insertion portion.

The elastic member may be inserted into the elastic member insertion portion by interference fitting.

In accordance with an aspect of an example embodiment, an air conditioner includes a housing having a discharge port, a blade configured to rotate with respect to the housing to open or close the discharge port, a blade driving member having a drive source where the blade driving member is configured to rotate the blade, and an elastic member located between the blade and the blade driving member where the elastic member is formed in a polygonal pillar shape, wherein the blade driving member may include a driving member cover configured to cover the drive source and including a driving member support portion configured to support the blade driving member in a direction opposite to a separation direction of the blade while the blade is separated from the blade driving member.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
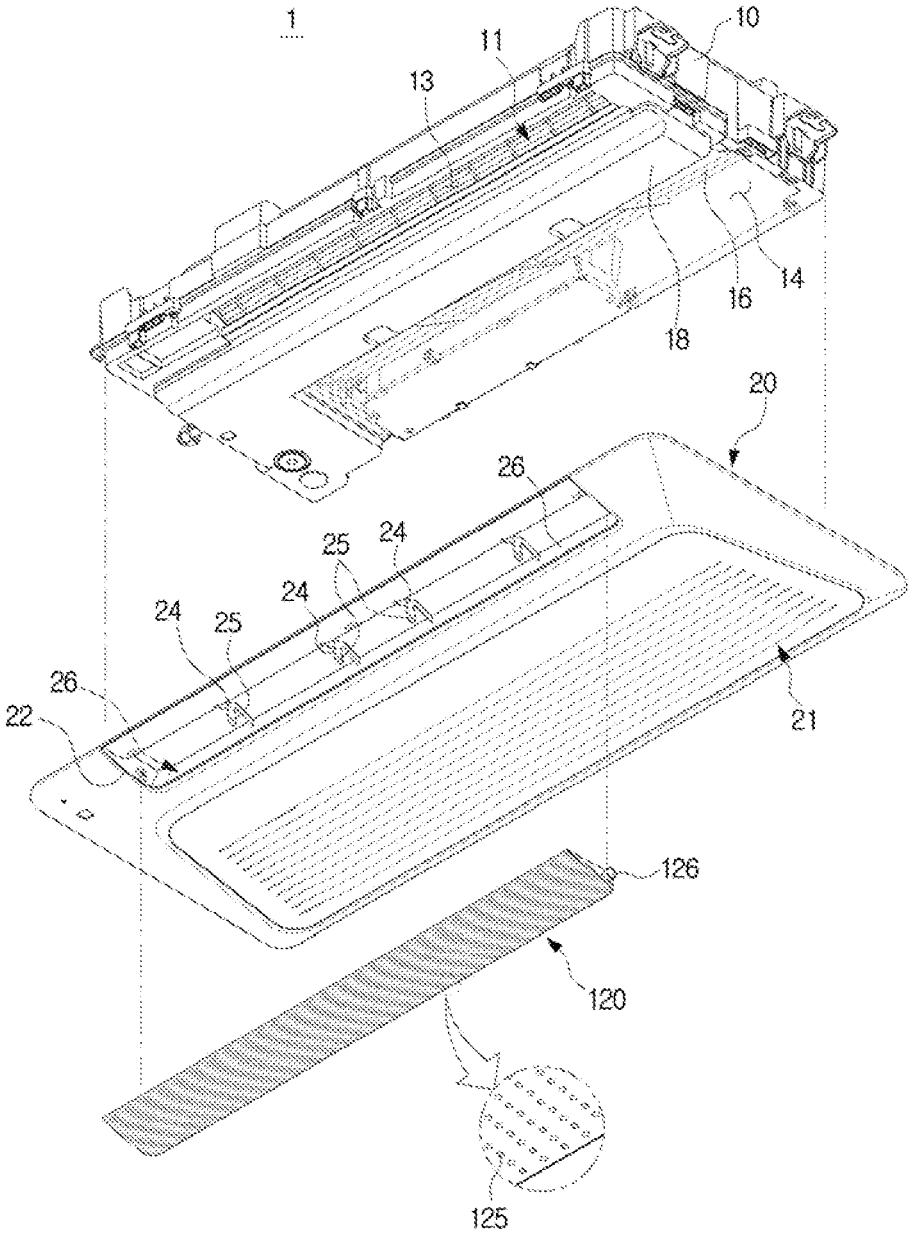
FIG. 1 is an exploded perspective illustrating an air conditioner and a blade applied thereto according to an embodiment.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

The terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having" are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

As used herein, the term "and/or" includes any and all combinations of one or more of the associated listed items.

Meanwhile, the terms "in front of", "behind", "on", and "under" are defined based on the drawings and the shape and position of each element are not limited by these terms.

A refrigeration cycle of an air conditioner is performed by using a compressor, a condenser, an expansion valve, and an evaporator. The refrigeration cycle includes a series of processes involving compression, condensation, expansion, and evaporation and supplies conditioned air heat-exchanged with a refrigerant.

The compressor compresses a refrigerant gas in a high-temperature and high-pressure state and discharges the compressed refrigerant gas. The discharged refrigerant gas flows into the condenser. The condenser condenses the compressed refrigerant into a liquid phase and heat is released to the surroundings via a condensation process.

The expansion valve expands the liquid phase refrigerant in a high-temperature and high-pressure state condensed in the condenser into a liquid phase refrigerant in a low-pressure. The evaporator evaporates the refrigerant expanded in the expansion valve and returns the refrigerant gas in a low-temperature and low-pressure state to the compressor. The evaporator may achieve refrigeration effects via heat exchange with a material to be cooled using latent heat of evaporation of the refrigerant. The air conditioner may adjust temperature of an indoor space throughout this cycle.

An outdoor unit of the air conditioner refers to a part of the refrigeration cycle including the compressor and an outdoor heat exchanger. An indoor unit of the air conditioner includes an indoor heat exchanger, and the expansion valve may be provided in the indoor unit or the outdoor unit. The indoor heat exchanger and the outdoor heat exchanger serve as a condenser or an evaporator. When the indoor heat exchanger is used as a condenser, the air conditioner serves as a heater, and when the indoor heat exchanger is used as an evaporator, the air conditioner serves as a cooler.

Hereinafter, embodiments of the present disclosure will be described in detail with reference to the accompanying drawings.

Also, although an indoor unit of a ceiling-type air conditioner will be described by way of example for descriptive convenience, a blade according to an embodiment may also be applied to indoor units of any other types of air conditioners such as standing-type air conditioners and wall-mounted air conditioners.

Figure 2:
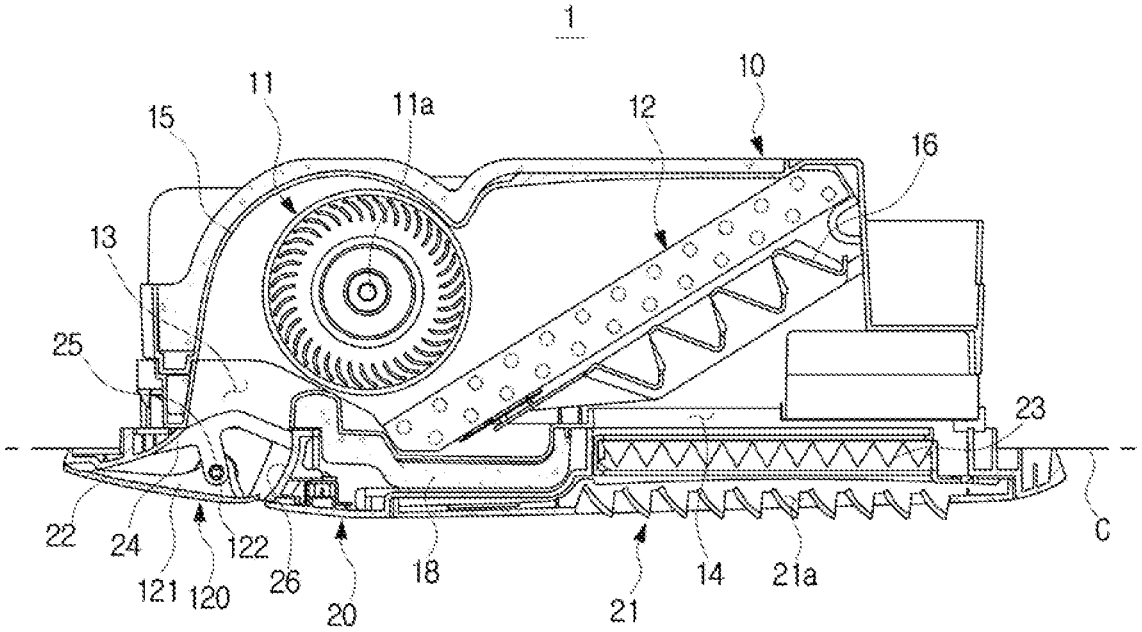
FIG. 2 is a cross-sectional view schematically illustrating the air conditioner of FIG. 1.

FIG. 1 is an exploded perspective illustrating an air conditioner 1 and a blade 120 applied thereto according to an embodiment. FIG. 2 is a cross-sectional view schematically illustrating the air conditioner 1 of FIG. 1.

Referring to FIGS. 1 and 2, the air conditioner 1 according to an embodiment may include a main body 10 mounted on a ceiling C or recessed in the ceiling C and a housing 20 coupled to a lower portion of the main body 10.

The main body 10 may be formed in an approximate box-shape. The main body 10 may include a heat exchanger 12 to perform heat exchange between sucked indoor air and a refrigerant, a blower fan 11 forcibly blowing air, and a control unit (not shown) to control the operation of the air conditioner 1.

The main body 10 includes an upper surface and side surfaces constituting front, rear, left, and right sides. The main body 10 may include a scrolling device 15 configured to guide air heat-exchanged while passing through the heat exchanger 12 toward an air discharge port 13.

A suction port 14 to suck air from an indoor room into the main body 10 and the air discharge port 13 to return heat-exchanged air into the indoor room may be provided at lower portions of the main body 10. The air discharge port 13 may be provided with a wind direction adjusting member (not shown) to control a lateral direction of the discharged air.

The heat exchanger 12 may include a tube in which the refrigerant flows and heat exchanging fins in contact with the tube to increase a heat transfer area. The heat exchanger 12 may be inclined to be approximately perpendicular to a direction of an air flow.

A guide rib 16 to guide the indoor air sucked into the main body 10 through the suction port 14 toward the heat exchanger 12 may be located between the heat exchanger 12 and the suction port 14. The guide rib 16 may be inclined to be approximately perpendicular to an arranged direction of the heat exchanger 12.

A drain cover 18 to collect condensate generated in the heat exchanger 12 may be located under the heat exchanger 12. Condensate collected in the drain cover 18 may be drained out through a drain hose (not shown).

The blower fan 11 may forcibly blow air while being rotated by a driving force of a drive motor (not shown). A rotary shaft 11*a* of the blower fan 11 may be arranged in approximately parallel to the ground. The blower fan 11 may be a cross-flow fan.

The housing 20 may include a grille 21 provided at a position corresponding to the suction port 14 to prevent foreign substances from entering the main body 10 and a panel discharge port 22 located at a position corresponding to the air discharge port 13. The blade 120 may be rotatably provided at the panel discharge port 22 to open or close the panel discharge port 22 or adjust a vertical direction of discharged air. Since the panel discharge port 22 is provided in the housing 20 and connected to the air discharge port 13, both the air discharge port 13 and the panel discharge port 22 will be collectively referred to as a discharge port 22 hereinafter.

The housing 20 may include a filter member 23 to remove foreign substances from air sucked into the main body 10 through the suction port 14.

Since the filter member 23 needs to be cleaned or replaced after use due to a lot of foreign substances stacked thereon, the grille 21 may be provided to be selectively opened from the housing 20 to easily separate the filter member 23 therefrom. The grille 21 may be fixed to the housing 20 at a rear portion and rotatable to be opened or closed in a state of being supported thereby.

The grille 21 may include a grille suction port 21*a* located in front of the filter member 23 of the housing 20 and at least one portion of the grille suction port 21*a* is cut.

The housing 20 may include a support member 24 rotatably supporting the blade 120. The support member 24 may be formed to connect both ends of the discharge port 22 in a widthwise direction (in a forward and backward direction of FIG. 1).

The support member 24 may have a blade coupling portion 25 to which the blade 120 is rotatably coupled. The blade coupling portion 25 may have a hole shape. A coupling protrusion 122 of an extended rib 121 of the blade 120 may be rotatably inserted into the blade coupling portion 25.

The housing 20 may include an air guide 26 located in the discharge port 22 and configured to guide air discharged from the discharge port 22. The air guide 26 may have a curved shape to guide the air. The air guide 26 may be detachably coupled to the housing 20 through the discharge port 22.

The air conditioner 1 may include a blade driving unit 110 located at both ends of the blade 120 and configured to rotate the blade 120. The blade driving unit 110 may be located at both ends of the blade 120 or only one of the both ends.

Hereinafter, the blade driving unit 110 and the blade 120 according to an embodiment will be described in detail.

Figure 3:
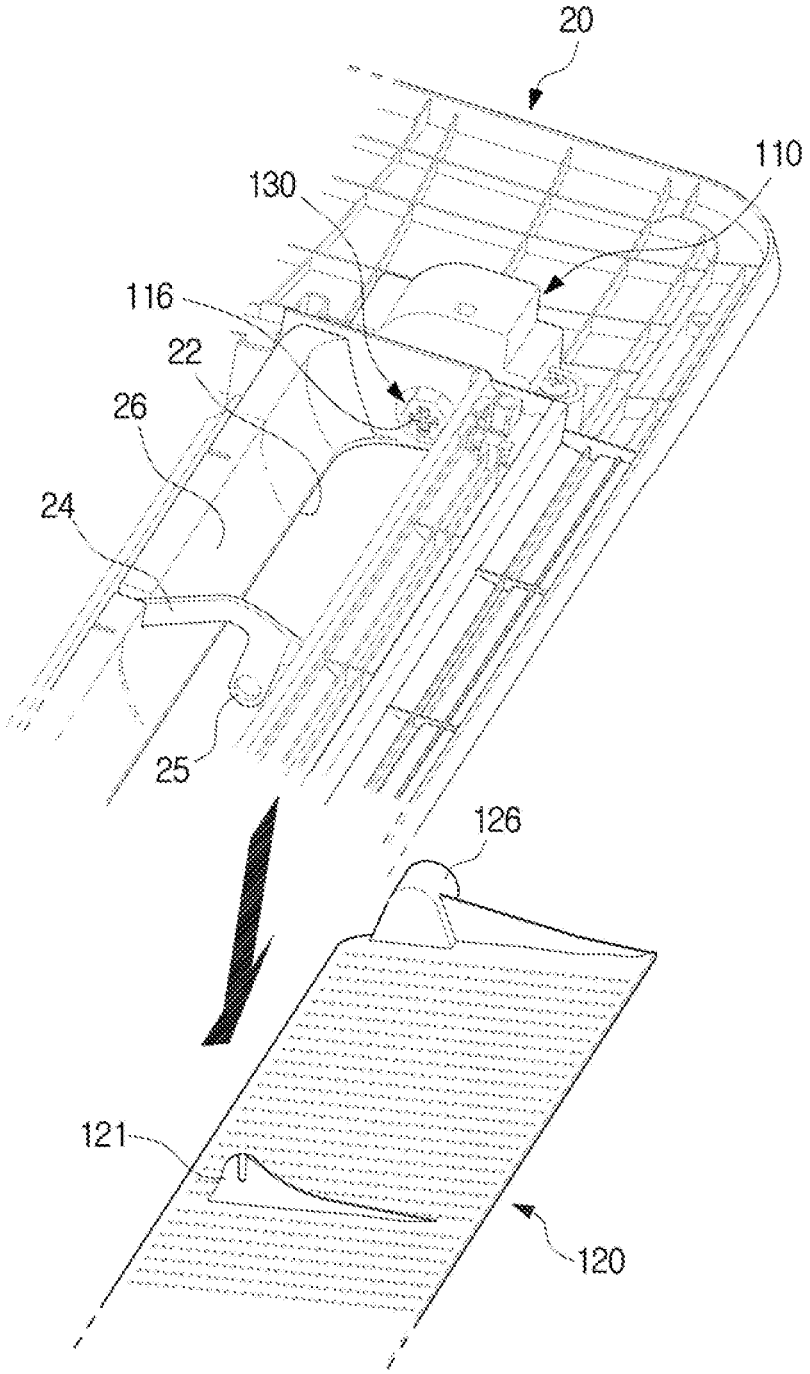
FIG. 3 is a diagram illustrating a state in which the blade is separated from the housing illustrated in FIG. 1.
Figure 4:
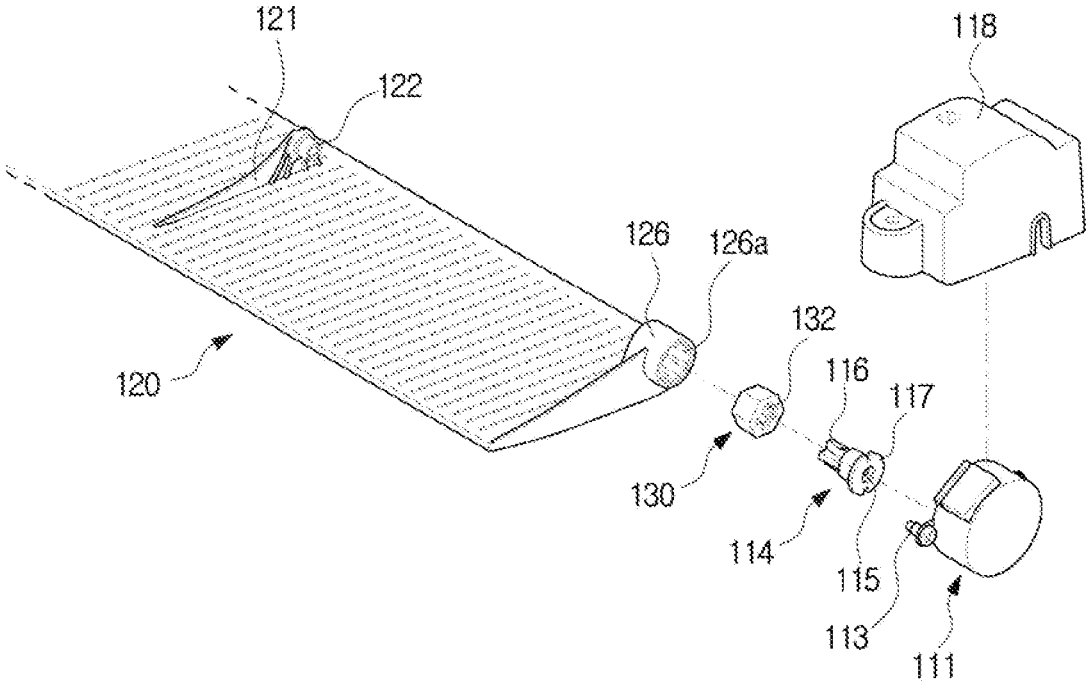
FIG. 4 is a top exploded view of the blade and the blade driving unit illustrated in FIG. 3.
Figure 5:
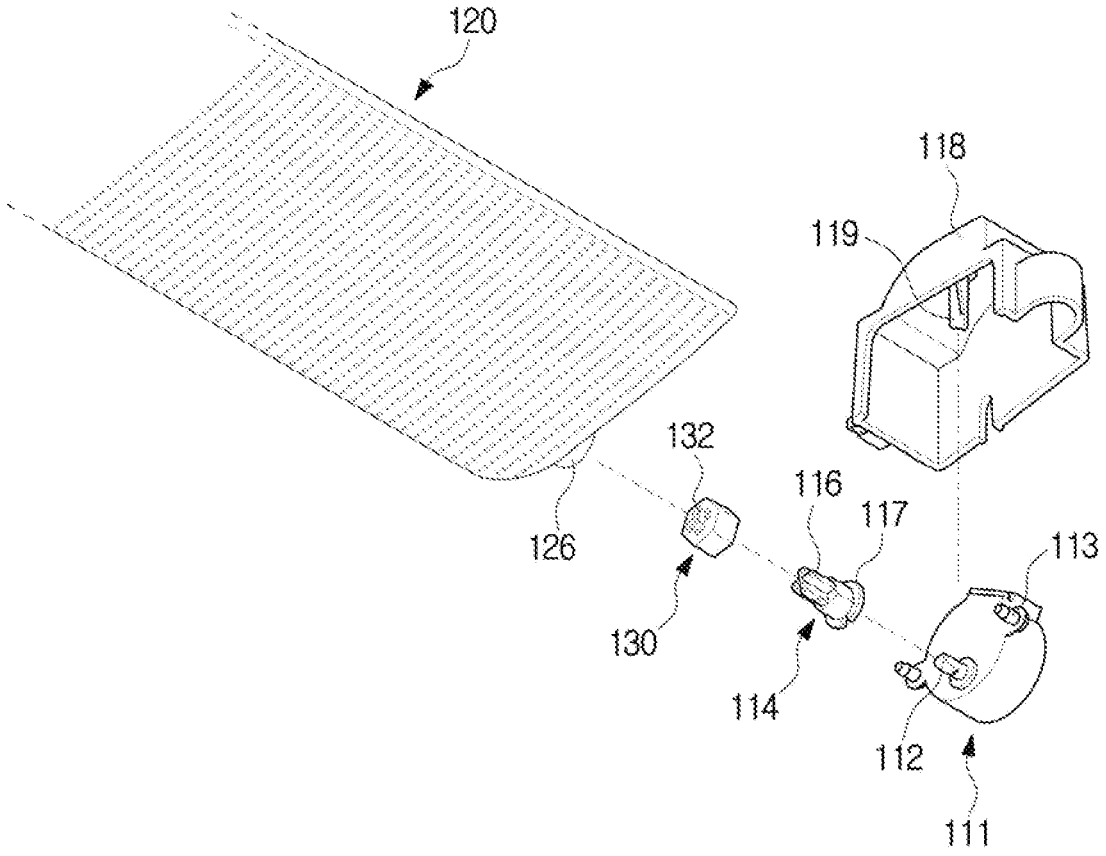
FIG. 5 is a bottom exploded view of the blade and the blade driving unit illustrated in FIG. 3.

FIG. 3 is a diagram illustrating a state in which the blade 120 is separated from the housing 20 illustrated in FIG. 1. FIG. 4 is a top exploded view of the blade 120 and the blade driving unit 110 illustrated in FIG. 3. FIG. 5 is a bottom exploded view of the blade 120 and the blade driving unit 110 illustrated in FIG. 3.

The blade driving unit 110 may include a drive source 111 configured to generate power to rotate the blade 120 and a power transmission member 114 configured to transmit the power generated by the drive source 111 to the blade 120.

The drive source 111 may be a bidirectional motor that turns in both directions. The drive source 111 may include a shaft 112 inserted into a drive source insertion groove 115 of the power transmission member 114.

The shaft 112 may have a non-circular cross-section to transmit a rotational force to the power transmission member 114. For example, the shaft 112 may have a circular cross-section one portion of which is cut. The shaft 112 is not limited there to and may have any shape capable of transmitting the power generated by the drive source 111 to the power transmission member 114 without slip.

The drive source 111 may be fixed to the housing 20 via a fastening member 113. The fastening member 113 may be a bolt.

The power transmission member 114 may transmit the power received from the drive source 111 to an elastic member 130. The power transmission member 114 may include a drive source insertion groove 115 to which the shaft 112 of the drive source 111 is inserted. The drive source insertion groove 115 may have a cross-section formed in a non-circular shape to receive the rotational force from the drive source 111 without slip. The drive source insertion groove 115 may be provided in a shape corresponding to the shape of the shaft 112.

The power transmission member 114 may have an extended portion 116 extending along a direction of a rotation axis of the blade 120 and having a polygonal pillar shape. The extended portion 116 may be inserted into a driving unit insertion portion 132 of the elastic member 130. The extended portion 116 may have a non-circular shape to transmit the power received from the drive source 111 to the elastic member 130. The extended portion 116 may have an approximate "X" shape.

The power transmission member 114 may include an elastic member fixing portion 116*a* to which a stopper 131 of the elastic member 130 is coupled. Particularly, the elastic member fixing portion 116*a* may be formed at the extended portion 116 of the power transmission member 114. The elastic member fixing portion 116*a* may be formed in a groove shape at an outer surface of the extended portion 116. The elastic member fixing portion 116*a* may be formed in a shape corresponding to the shape of the stopper 131. The stopper 131 of the elastic member 130 may be inserted into the elastic member fixing portion 116*a*. The elastic member fixing portion 116*a* may be provided plural in number.

The power transmission member 114 may have a rib 117 protruding to be supported by the driving unit support portion 119. The rib 117 may extend in a radial direction from the rotation axis of the power transmission member 114. The rib 117 may extend in at least one region in the radial direction of the power transmission member 114. The rib 117 may extend to be interfered by the driving unit support portion 119.

The blade driving unit 110 may include a driving unit cover 118 to cover the drive source 111 and at least one portion of the power transmission member 114. The driving unit cover 118 may be coupled to the housing 20 and protect the drive source 111 and/or the power transmission member 114 from foreign substances.

The driving unit cover 118 may include a driving unit support portion 119 provided to support the power transmission member 114 in a direction opposite to a separation direction of the blade 120 when the blade 120 is separated from the blade driving unit 110. The driving unit support portion 119 may support at least one portion of the rib 117 of the power transmission member 114. The driving unit support portion 119 may extend from an inner side of the driving unit cover 118 to interfere with the rib 117.

The blade 120 may be rotatably provided in the discharge port 22. As the blade 120 rotates in the discharge port, the discharge port 22 may be opened or closed. When the blade 120 is located in a closing position where the discharge port 22 is closed. The blade 120 may rotate to control a direction of air blown from the blower fan 11 and discharged through the discharge port 22 by opening the discharge port 22. The blade 120 may rotate within a predetermined angle with respect to the housing 20 to control the direction of air discharged through the discharge port 22. The blade 120 may be formed of a flexible material to be easily coupled to the housing 20.

The blade 120 may include a coupling protrusion 122 rotatably inserted into the blade coupling portion 25. The coupling protrusion 122 may be disposed at the extended rib 121 protruding from an upper surface of the blade 120. The extended rib 121 may be arranged to correspond to the support member 24.

The blade 120 may have a plurality of air discharge holes 125 penetrating the blade 120. Air passing through the discharge port 22 may be discharged out of the housing 20 through the plurality of air discharge holes 125. The plurality of air discharge holes 125 may be distributed to be spaced at regular intervals. However, the embodiment is not limited thereto and the air discharge holes 125 may also be concentrated in a predetermined region of the blade 120.

Since the air conditioner 1 discharges air through the plurality of air discharge holes 125, air may be discharged out of the housing 20 at a low speed. Accordingly, the user may achieve the purpose of air conditioning with no direct wind and thus the air conditioner 1 may improve satisfaction of the user.

Although the blade 120 including the plurality of air discharge holes 125 has been described according to the present embodiment, the spirit of the present disclosure may also be applied to air conditioners including a blade with no air discharge holes.

The blade 120 include driving unit coupling portions 126 to be coupled to the blade driving unit 110 at both ends. When the blade driving unit 110 is provided at only one end, the driving unit coupling portion 126 may also be provided at only one end of the blade 120.

The driving unit coupling portion 126 may have an elastic member insertion portion 126*a* into which the elastic member 130 is inserted. The elastic member insertion portion 126*a* may have a shape corresponding to a shape of the elastic member 130.

Particularly, the elastic member 130 inserted into the elastic member insertion portion 126*a* may have a polygonal pillar shape such that the blade 120 receives a rotational force from the blade driving unit 110, and the elastic member insertion portion 126*a* may have a shape corresponding to the polygonal pillar shape of the elastic member 130. For example, the elastic member 130 may have an approximately hexagonal pillar shape, and the elastic member insertion portion 126*a* may be formed such that a cross-section perpendicular to the rotation axis has an approximately hexagonal pillar shape corresponding to the shape of the elastic member 130.

The elastic member 130 may be provided between the blade driving unit 110 and the blade 120 to reduce noise and vibration while the blade 120 rotates. To this end, the elastic member 130 may include rubber.

The elastic member 130 may be inserted into the elastic member insertion portion 126*a* by interference fitting. The elastic member 130 may have a polygonal pillar shape. For example, the elastic member 130 may have a hexagonal pillar shape. The elastic member 130 may transmit the power received from the power transmission member 114 to the blade 120.

The elastic member 130 may include a stopper (FIG. 7) to be fixed to the blade driving unit 110. The stopper 131 may protrude from an inner surface of the driving unit insertion portion 132 of the elastic member 130. The stopper 131 may have a protruding shape. The stopper 131 may be inserted into the elastic member fixing portion 116*a* of the power transmission member 114. The stopper 131 may be provided plural in number along the inner surface of the elastic member 130.

According to this configuration, the elastic member 130 may be fixed to the power transmission member 114 and separated from the blade 120 when the blade 120 is separated from the blade driving unit 110. That is, when the blade 120 is separated from the housing 20 of the air conditioner 1, the blade driving unit 110 and the elastic member 130 are fixed to the housing 20 and only the blade 120 may be separated from the housing 20.

The elastic member 130 may be provided to correspond to the shape of the extended portion 116 and may include the driving unit insertion portion 132 into which the extended portion 116 is inserted. The driving unit insertion portion 132 may be formed such that a cross-section perpendicular to the rotation axis of the blade 120 has an approximate "X"

shape. The driving unit insertion portion 132 may be formed to receive the power form the extended portion 116 without slip.

Figure 6:
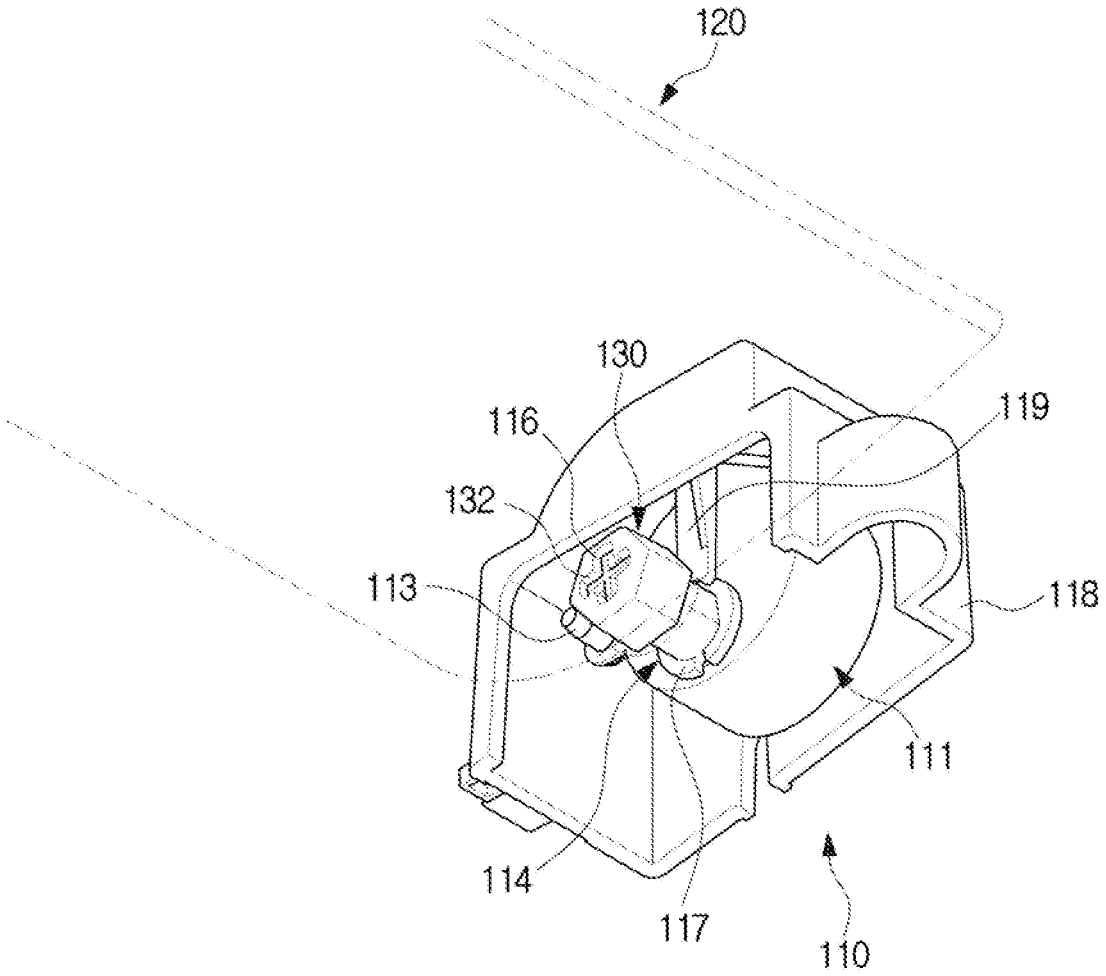
FIG. 6 is a diagram illustrating the inside of the blade driving unit when the blade is coupled to the blade driving unit illustrated in FIG. 3.
Figure 7:
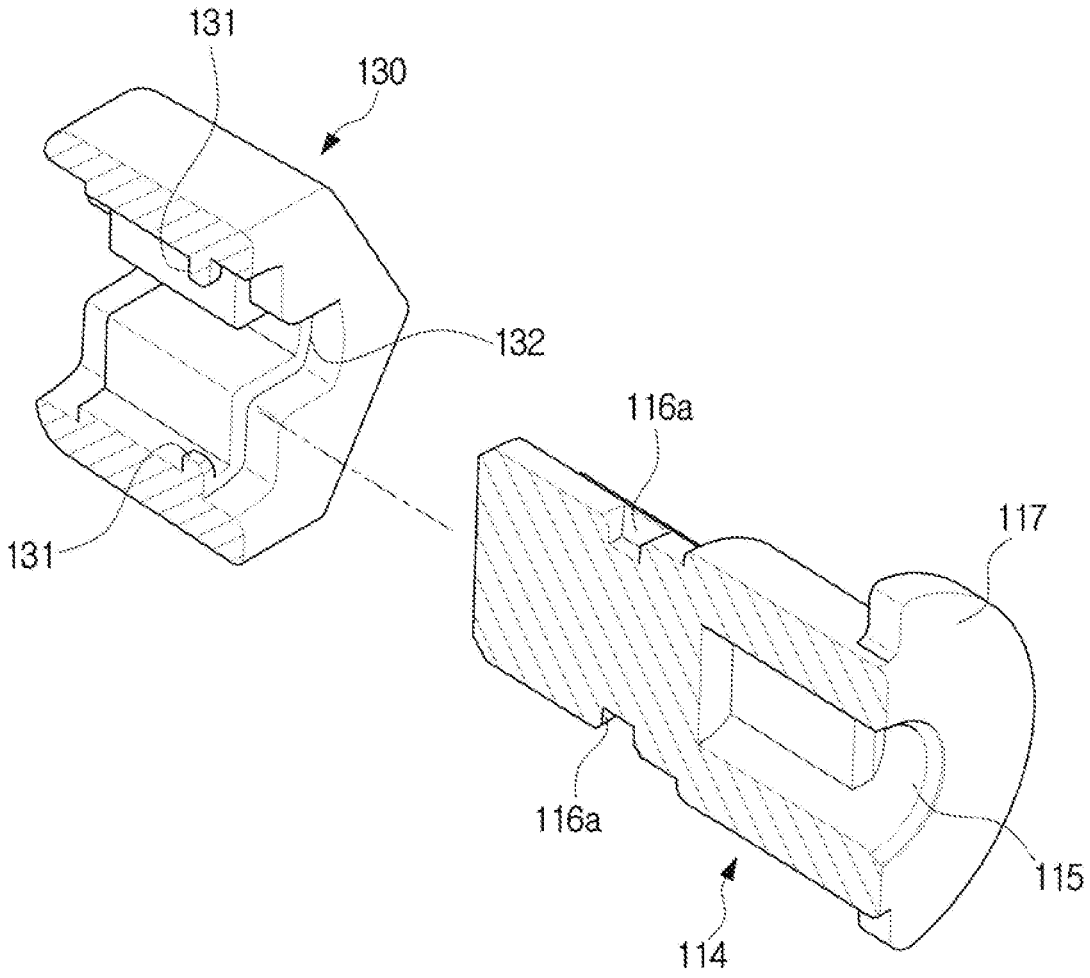
FIG. 7 is a cross-sectional view illustrating a coupled relationship between the elastic member and the power transmission member illustrated in FIGS. 3 and 4.
Figure 8:
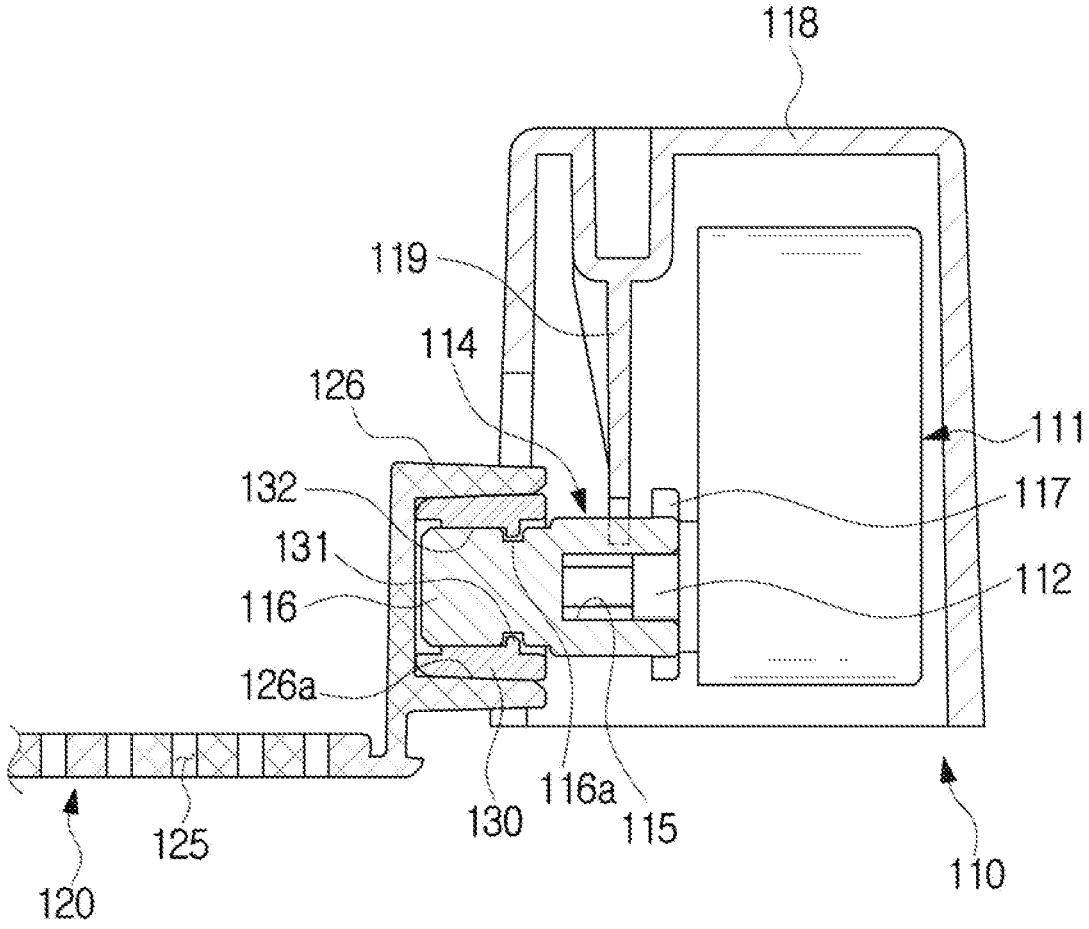
FIG. 8 is a cross-sectional view illustrating a coupled state of the blade, the elastic member, and the blade driving unit illustrated in FIG. 3.

FIG. 6 is a diagram illustrating the inside of the blade driving unit 110 when the blade 120 is coupled to the blade driving unit 110 illustrated in FIG. 3. FIG. 7 is a cross-sectional view illustrating a coupled relationship between the elastic member 130 and the power transmission member 114 illustrated in FIGS. 3 and 4. FIG. 8 is a cross-sectional view illustrating a coupled state of the blade 120, the elastic member 130, and the blade driving unit 110 illustrated in FIG. 3.

Referring to FIG. 6, the driving unit support portion 119 may extend downward from an inner surface of the driving unit cover 118 to support the rib 117 such that the power transmission member 114 does not move toward the blade 120 along the direction of the rotation axis of the blade 120. Thus, when the blade 120 is separated from the blade driving unit 110, the power transmission member 114 may be separated from the blade 120 and maintain in a state of being installed in the housing 20 without being separated from the housing 20 together with the blade 120.

Referring to FIG. 7, the elastic member 130 may be fixed to the power transmission member 114 as the stopper 131 is inserted into the elastic member fixing portion 116*a*. Since the elastic member 130 is formed of an elastic material, the stopper 131 may be naturally deformed, move along the extended portion 116, and be inserted into the elastic member fixing portion 116*a* while the extended portion 116 is inserted into the driving unit insertion portion 132.

Referring to FIG. 8, since the rib 117 is supported by the driving unit support portion 119, the power transmission member 114 may be maintained in a state of being connected to the drive source 111 not to be separated together with the blade 120 in the case where the blade 120 is separated. The stopper 131 may be inserted into the elastic member fixing portion 116*a* and fixed to the power transmission member 114 such that the elastic member 130 is not separated from the blade driving unit 110 together with the blade 120 when the blade 120 is separated. Thus, when the blade 120 is separated from the blade driving unit 110, the elastic member 130 may be fixed to the blade driving unit 110 and only the blade 120 may be separated.

According to this configuration, the user may easily separate the blade 120 from the housing 20 for maintenance and repair of the blade 120 of the air conditioner 1. Also, since the elastic member 130 is fixed to the blade driving unit 110, misassembly that may occur in the case where the elastic member 130 is separately coupled may be prevented when the blade 120 is coupled to the housing 20 after maintenance and repair work of the blade 120. In addition, since the elastic member 130 is provided between the blade 120 and the blade driving unit 110, the air conditioner 1 may have reduced noise and/or vibration that may occur while driving the blade 120.

As is apparent from the above description, the elastic member of the air conditioner according to an embodiment is separated from the blade when the blade is separated from the blade driving unit, the blade may be easily separated from or coupled to the blade driving unit.

The blade of the air conditioner according to an embodiment may be easily maintained and repaired since the blade is easily separated from and coupled to the blade driving unit.

The air conditioner according to an embodiment may have reduced noise or vibration while the blade rotates since the elastic member is provided between the blade and the blade driving unit.

The air conditioner according to an embodiment may discharge air by using various methods since the blade has the plurality of air discharge holes.

The air conditioner according to an embodiment may cool and/or heat the indoor room at a minimum wind speed providing the user with comfort since the blade has the plurality of air discharge holes.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An air conditioner comprising:

a housing having a discharge port;

a blade located at the discharge port, the blade being rotatable with respect to the housing;

a motor configured to generate power to rotate the blade and the blade being separable from the motor;

a power transmission member including an insertion groove and coupleable to the motor to cause the power transmission member to rotate and to transmit the power to the blade, the power transmission member including a rib positioned at a longitudinal end of the power transmission member and formed to extend in a radial direction from a rotation axis of the power transmission member;

a shaft formed to protrude from the motor to couple the motor to the power transmission;

a driving member cover to cover the motor and at least a portion of the power transmission member; and an elastic member located between the blade and the motor, the elastic member including a stopper formed to be coupleable to the power transmission member, wherein the stopper allows the elastic member to remain coupled with the power transmission member while the blade is being separated from the motor, wherein the driving member cover comprises a driving member support portion provided to interfere with a movement of the rib of the power transmission member while the blade is being moved in a separation direction from the power transmission member.

2. The air conditioner of claim 1, wherein the power transmission member comprises an elastic member fixing portion to which the stopper is coupled.

3. The air conditioner of claim 2, wherein the elastic member is fixed to the power transmission member and is separated from the blade while the blade is being separated from the motor.

4. The air conditioner of claim 2, wherein the power transmission member comprises an extended portion formed to extend along the rotation axis direction of the power transmission member, the extended portion being formed in a polygonal pillar shape, and the elastic member comprises a power transmission member insertion portion formed to accommodate the polygonal pillar shape of the extended portion so that the extended portion is inserted into the power transmission member insertion portion.

5. The air conditioner of claim 4, wherein the stopper protrudes from an inner surface of the elastic member and the elastic member fixing portion is formed as a groove into an outer surface of the extended portion.

6. The air conditioner of claim 1, wherein the blade comprises an elastic member insertion portion formed to accommodate a shape of the elastic member to allow the elastic member to be inserted into the elastic member insertion portion.

7. The air conditioner of claim 6, wherein while the elastic member is inserted into the elastic member insertion portion the elastic member is retained by an interference fitting.

8. The air conditioner of claim 1, wherein the elastic member has a polygonal pillar shape.

9. The air conditioner of claim 1, wherein the elastic member comprises rubber.

10. The air conditioner of claim 1, wherein the housing is formed to be installed at a ceiling.

11. The air conditioner of claim 1, wherein the blade is configured to open and close the discharge port.

12. The air conditioner of claim 11, wherein the blade comprises a plurality of air discharge holes penetrating the blade.

13. An air conditioner comprising:

a housing formed to be installed at a ceiling, the housing including a discharge port;

a blade configured to rotate with respect to the housing to open and close the discharge port, the blade including a plurality of air discharge holes;

a blade driving member configured to provide power to rotate the blade and including a motor configured to generate power to rotate the blade and the blade being separable from the motor;

a power transmission member including an insertion groove and coupleable to the motor to rotate the power transmission member and to transmit the power to the blade, the power transmission member including a rib positioned at a longitudinal end of the power transmission member and formed to extend in a radial direction from a rotation axis of the power transmission member;

a shaft formed to protrude from the motor to couple the motor to the power transmission member and to transmit the power to the power transmission member;

a driving member cover to cover the motor and a least a portion of the power transmission member including the rib and an elastic member located between the blade and the blade driving member and including a stopper formed to be coupleable to the blade driving member, wherein the stopper allows the elastic member to remain coupled to the power transmission member while the blade is being separated from the blade driving member, wherein the driving member cover comprises a driving member support portion provided to interfere with a movement of the rib of the power transmission member while the blade is being moved in a separation direction from the power transmission member.

14. The air conditioner of claim 13, wherein the power transmission member comprises an elastic member fixing portion formed in a groove shape, and the stopper inserted into the elastic member fixing portion.

15. The air conditioner of claim 13, wherein the elastic member is formed in a hexagonal pillar shape, and the blade comprises an elastic member insertion portion formed to accommodate the hexagonal pillar shape of the elastic member to allow the elastic member to be inserted into the elastic member insertion portion.

16. The air conditioner of claim 15, wherein when the elastic member is inserted into the elastic member insertion portion the elastic member is retained by an by interference fitting.

17. An air conditioner comprising:

a housing having a discharge port;

a blade configured to rotate with respect to the housing to open or close the discharge port;

a blade driving member having a motor configured to generate power to rotate the blade, and the blade being separable from the motor;

a power transmission member including an insertion groove and coupleable to the motor to cause the power transmission member to rotate and to transmit the power to the blade, the power transmission member including a rib positioned at a longitudinal end of the power transmission member and formed to extend in a radial direction from a rotation axis of the power transmission member;

a shaft formed to protrude from the motor to couple the motor to power transmission member and to transmit the power to the power transmission member, the blade driving member being configured to provide power to rotate the blade;

a driving member cover to cover the motor and at least a portion of the power transmission member including a rib; and an elastic member located between the blade and the blade driving member, the elastic member being formed in a polygonal pillar shape, wherein the stopper allows the elastic member to remain coupled with the power transmission member while the blade being separated from the blade driving member, wherein the driving member cover comprises a driving member support portion provided to interfere with a movement of the rib of the power transmission member while the blade is being moved in a separation direction from the power transmission member.

* * * * *